United States Patent [19]

Kadish et al.

[11] 4,063,513

[45] Dec. 20, 1977

[54] TARGET SENSING DEVICE

[75] Inventors: Ben-Ami Kadish, Clifton, N.J.; David I. Parker, Grabill, Ind.

[73] Assignee: The United States of America as represented by the Secretary of the Army, Washington, D.C.

[21] Appl. No.: 725,803

[22] Filed: Sept. 23, 1976

[51] Int. Cl.[2] ..... F42C 19/02

[52] U.S. Cl. ..... 102/70.2 R

[58] Field of Search ..... 102/70.2 R

[56] References Cited

U.S. PATENT DOCUMENTS

| | | | |
|---|---|---|---|
| 3,717,098 | 2/1973 | Davis et al. | 102/70.2 R |
| 3,903,805 | 9/1975 | Hovnanian | 102/70.2 R |

*Primary Examiner*—Charles T. Jordan

*Attorney, Agent, or Firm*—Nathan Edelberg; A. Victor Erkkila; Max Yarmovsky

[57] ABSTRACT

A plurality of radio frequency shielded electrical break wire sensors for a missile fuze circuit are peripherally positioned on the circumferential outer surface of a warhead body. A first wire sensor provides an electrical indication of contact of the warhead outer surface with a target structure and initiation of the fuze electronics in response thereto. A second printed wire sensor is operatively positioned underneath the first sensor to provide an electrical indication of an impending break-up of the warhead body structure and initiation of the missile fuze.

4 Claims, 2 Drawing Figures

TARGET SENSING DEVICE

GOVERNMENTAL INTEREST

The invention described herein was made in the course of a contract with the Government and may be manufactured, used and licensed by or for the Government for governmental purposes without the payment to us of any royalty thereon.

BACKGROUND OF THE INVENTION

Various means have been used in the prior art to determine exactly when a warhead impacted with a target. The problem with prior art wire impact sensing devices was that the fuzing signal generated by the sensor generally occurred after target penetration. The late fuzing signal frequently resulted in warhead damage and consequently a reduction in explosive effectiveness.

SUMMARY OF THE INVENTION

The present invention relates to a radio frequency shielded dual electrial wire target sensing device. A first target contact sensing break wire type sensor is slidably attached to the warhead body in such manner as to facilitate breaking of the wire sensor under target contact conditions. A second hard target printed circuit break wire impact sensor is fixedly located in an annular groove in the warhead body beneath the first target sensing switch. Breaking of either the first or second sensor causes an electrical discontinuity which initiates the projectile's fuze.

An object of the present invention is to provide a radio frequency shielded break wire sensor for a missile fuze which is sensitive to both target surface contact and hard target impact.

Another object of the present invention is to provide a missile break wire sensor which utilizes a fluorocarbon undercoating under the break wire to minimize the structural bond between the conductor and the missile to facilitate breaking of the sensor under target contact conditions.

A further object of the present invention is to provide a radio frequency shielded break wire sensor for initiating a missile fuze which can differentiate between normal target contact and impact with a hard target and which provides a fuzing signal before warhead damage occurs.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENTS

Figure 1:
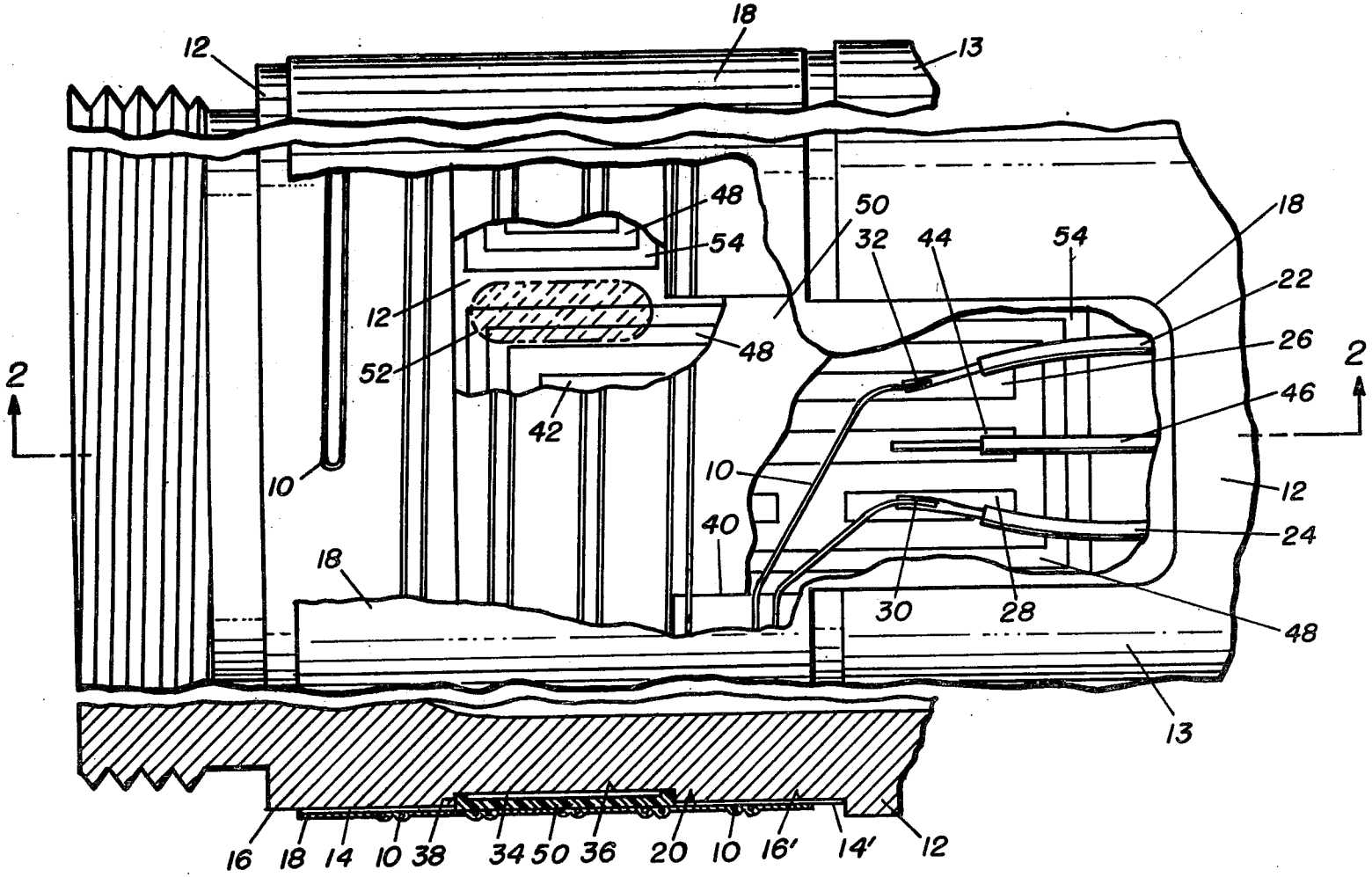
FIG. 1 is a partial cutaway cross-sectional view of the target sensing device located on a warhead body.
Figure 2:
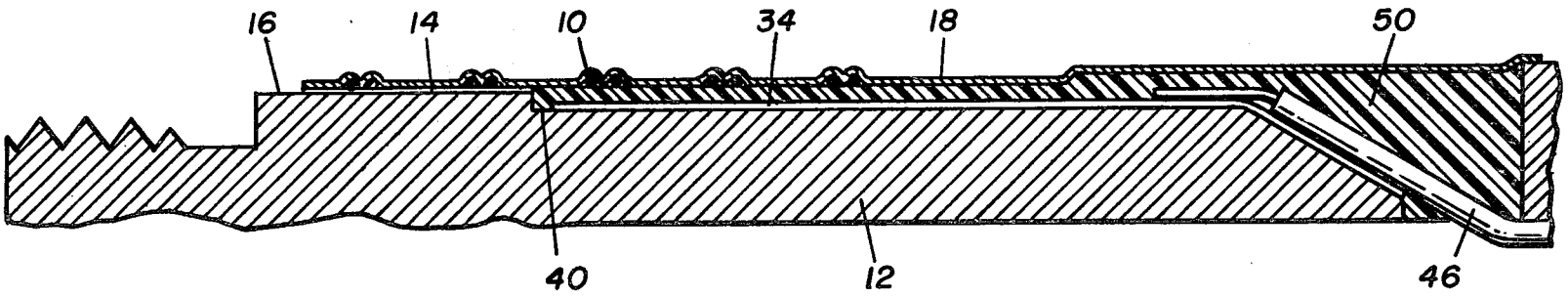
FIG. 2 is a cross-sectional view taken along line 2—2 of FIG. 1.

Referring now to FIGS. 1 and 2 the first break wire mechanism comprises a target sensing magnet wire member 10 circumferentially disposed as a bifilar winding around a warhead body section 12 of a projectile 13. Warhead body 12 has a 0.002 of an inch thick substrate of fluorocarbon coating 14 and 14' applied to a pair of peripheral band surfaces 16 and 16' respectively prior to the winding of target contact sensing break wire 10 thereon. The purpose of the fluorocarbon coating 14 and 14' is twofold. The first purpose is to provide additional insulation between the magnet wire 10, that serves as a target sensing element, and the warhead body 12. The second function of coating 14 and 14' is to limit adhesion of the magnet wire 10 and an overlaying 0.00025 inch thick aluminum foil shield 18 to the warhead body 12 through the fluorocarbon characteristic of very poor adhesive property. The poor adhesion facilitates breakage of the wire pattern 10 when the warhead is abraded by contact with a target. An adhesive 20 is spread on the interior surface of annular aluminum foil electromagnetic shield 18, prior to the installation of the target sensing magnet wire 10, to help hold the foil shield 18 to the magnet wire 10. The magnet wire 10 is assembled to the outer surface of the warhead 12 in a pattern configured to minimize the magnet wire 10 acting as an antenna for picking up radio frequency energy. The magnet wire 10 is insulated from the warhead body 12 and from the aluminum foil shield by a thin lacquered coating, not shown, thereon. The purpose of the aluminum foil shield 18 is to electrically isolate or minimize the effects of radio frequency radiations which can induce electric currents in the wire pattern sensors. Wire leads 22 and 24, which pass through the warhead body 12 and make electrical connection to the missile fuze are soldered to printed wire terminals 26 and 28 and target sensing magnet wire ends 30 and 32 respectively.

A second break wire mechanism, hard target sensor 34, having a pressure sensitive adhesive back 36, is disposed in an annular machined groove 38 and is positioned intermediate the peripheral band surfaces 16, 16' and in longitudinal slot 40 which communicates with band surface 16'. The hard target sensor 34 comprises a printed break wire circuit 42 having terminals 26 and 44 connected to the fuzing circuit, not shown, by leads 22 and 46 respectively. A printed circuit shield loop 48 helps to isolate the hard target electrical circuit 42 from electrical radiations and/or leakage currents. The flexible printed circuit 34 is covered with a layer of hard, insulating and brittle epoxy resin material 50. An electrically conductive coating spot 52 is used to fixedly ground shield loop 48 to the warhead body 12 on the interior side.

In operation the missile fuze electronics (not shown) which is connected to leads 22, 24 and 46 provides a low level of current that continually passes through the target sensor wire pattern 10 and through the hard target sensor printed break wire pattern 42. As the warhead body 12 contacts a target, the aluminum foil shield 18 and the magnet wire pattern 10 are abraded by the target, breaking the magnet wire 10, which is sensed by the fuze electronics as a discontinuance of current flow. Logic circuitry, not shown, within the fuze interprets the current discontinuance as a target encounter and provides a firing pulse to a fuze detonator, not shown, causing the warhead to explode. The fuze circuitry also provides a slight delay in time to allow the warhead to penetrate into the target before detonating the warhead. Under these latter conditions, as the warhead deforms the expoxy layer 50, installed over the printed circuit hard target sensor 34, fractures and begins to separate from the hard target sensor 34 assembly. As the epoxy layer 50 separates, it tears the printed circuit break wire 42 away from the insulator layer member 54 upon which the break wire electrical circuit 42 and 48 is printed, thereby causing an additional electrical discontinuity in the circuit. This latter electrical discontinuity in the fuzing circuit is interpreted by the fuze electronics as an indication of warhead breakup. At this point, the fuze electronics provides an immediate firing signal to the fuze detonator to detonate the warhead while a good degree of warhead structural integrity remains.

In the present embodiment, the hard target sensor 34 is installed on the machined warhead, and the target sensing switch member is installed over the hard target sensor. However, either sensor could be applied to any portion of the warhead, together or separately. The positions chosen for the sensors in the present embodiment have been selected to take maximum advantage of the warhead structure and the most probable encounter conditions with the target.

While there has been described and illustrated specific embodiments of the invention, it will be obvious that various changes, modifications and additions can be made herein without departing from the field of the invention which should be limited only by the scope of the appended claims.

Having thus fully described the invention, what is claimed as new and desired to be secured by Letters Patent of the United States is:

1. A target sensing device for initiating the warhead of a projectile which comprises:

a warhead body section having a pair of peripheral band surfaces thereon, an annular groove disposed intermediate said pair of band surfaces, and a longitudinal slot disposed through one of said pair of band surfaces and communicating with said annular groove;

a fluorocarbon coating disposed on said pair of band surfaces;

a hard target impact sensor means, fixedly disposed in said annular groove and in said longitudinal slot, for indicating breakup of said warhead body when said warhead body penetrates a target;

a target contact sensor means, operatively disposed on said fluorocarbon coating and partially covering said hard target impact sensor means, for indicating contact with said target; and shield means fixedly disposed over said target contact sensor means and said hard target impact sensor means for isolating said target contact sensor means and said hard target impact sensor means from radio frequency radiations.

2. A target sensing device as recited in claim 1 wherein said fluorocarbons coating comprises a substrate layer being 0.002 of an inch thick.

3. A target sensing device as recited in claim 1 wherein said hard target impact sensor means comprises a flexible printed break wire circuit disposed on an insulator layer member, said insulator layer member having a pressure sensitive adhesive back thereon for adhering to the base of said annular groove of said warhead body section, said break wire circuit including;

a printed circuit shield loop disposed on said insulator layer member circumambient said printed break wire circuit for shielding said hard target impact sensor from electrical radiations and leakage current;

an epoxy resin material disposed intermediate said break wire circuit and said target contact sensor means, said epoxy resin material fracturing, when said warhead body deforms due to an impact with said target, causing said printed break wire circuit to tear away from said insulated layer member and causing an electrical discontinuity therein which initiates the warhead of said projectile; and an electrically conductive coating spot disposed on said printed circuit shield loop and said warhead body electrically grounding said shield loop to said warhead body.

4. A target sensing device as recited in claim 1 wherein said target contact sensor means comprises:

an annular aluminum foil electro-magnetic shield, having an adhesive on an interior surface of said annular foil electro-magnetic shield, disposed on top of said fluorocarbon coating and said hard target impact sensor means; and bifilar wound magnet wire disposed intermediate said fluorocarbon coating and said hard target impact sensor means, fixedly attached by said adhesive to said interior surface of said annular foil electro-magnetic shield, said magnet wire and foil electro-magnetic shield sliding along said fluorocarbon coating and breaking when said foil electro-magnetic shield contacts said target, wherein the breaking of the magnet wire causes an electrical discontinuity which starts the initiation of the warhead of said projectile.

* * * * *